United States Patent [19]

Ueberschaar

[11] Patent Number: 4,600,029

[45] Date of Patent: Jul. 15, 1986

[54] HAIRPIECES

[76] Inventor: Maria Ueberschaar, 2910 N. Bay Dr., Westlake, Ohio 44145

[21] Appl. No.: 311,823

[22] Filed: Oct. 16, 1981

[51] Int. Cl.[4] ..... A41G 3/00

[52] U.S. Cl. ..... 132/53

[58] Field of Search ..... 132/53–55

[56] References Cited

U.S. PATENT DOCUMENTS

| | | | |
|---|---|---|---|
| D. 59,261 | 10/1921 | Muller | 132/53 UX |
| 541,125 | 6/1895 | Simonson | 132/54 |
| 1,133,196 | 3/1915 | Teugler | 132/53 |
| 1,897,747 | 2/1933 | Birk | 132/53 |
| 2,789,567 | 4/1957 | Jacoby | 132/53 |
| 3,550,161 | 12/1970 | Orozco | 132/53 X |

*Primary Examiner*—Gregory E. McNeill

*Attorney, Agent, or Firm*—J. Helen Slough

[57] ABSTRACT

The disclosure relates to a hairpiece comprising a plurality of individual hairs adjustably secured about an endless circular filament or filaments and the method of placement of the same on the head whereby the circular filament or filaments encircle the upper forward portion of the head, the sides and the lower back portion of the head beneath an upper layer and above underlying layer of hair on the head whereby the hairpiece is sandwiched between layers of the natural hair on the head.

5 Claims, 7 Drawing Figures

HAIRPIECES

This invention relates to improvements in hairpieces and particularly to a hairpiece consisting of artificial or natural hair secured to an endless strand or filament, which filament and attached hair is, according to the improved method disclosed herein, adapted to be sandwiched between layers of natural hair on the wearer's head.

The invention enables the wearer to add volume to the natural hair on the wearer's head and to dispose the hairpiece in a preferred position about the head so that additional length, additional volume, coverage or the like is obtained.

As an instance of the optional placement of the hair in different positions on the head, it may be preferred, where the hair is thin, or there is a bald spot, to mass a greater volume of hair for coverage in said location than in other positions where the hair on the circular ring is entrapped between underlying and overlying hair on the wearer's head and provision is made therefor by means whereby the attached hair is adjustably secured to the head encircling filament or strand.

In the prior art, hairpieces have been made of natural or artificial hair which are plaited and preformed members sewed to the plaits as shown in U.S. Pat. No. 2,865,380 to Mitchell; hair foundations have been placed on frame structures through which natural hair may extend, etc. such as shown in U.S. Pat. No. 1,424,845 to Nolan; hairpieces have been placed on gripping devices, clamps, wires or the like as shown in U.S. Pat. No. 1,638,016 to Oppenheim; U.S. Pat. No. 1,607,926 to Sterling; U.S. Pat. No. 1,351,427 to Krasmauskis; clip fasteners have been used to attach a hairpiece to the head as shown in U.S. Pat. No. 3,280,826 to Jenkins, but in the prior art in most cases, the hair is attached to the hair on the head by disposing the same over the natural hair.

In the present invention the wearer is not required to wear a wig which is uncomfortable and which must be separately dressed from the hair and further eliminates the wearing of transformations employing webbing or other frame structures or the use of wiglets and/or spring means, wires, ribbons, bands, plaiting, fasteners, clamps or the like.

It is an object of the invention therefor to provide a hairpiece or hairpieces which may be sandwiched between layers of natural hair and be invisible to an observer and supply additional volume of hair to the head.

A further object of the present invention is to provide means whereby the circular filament if traversing a part line will be virtually invisible in its crossing.

Another object of the invention is to provide means whereby the hair may be massed or distributed in lesser or greater amounts depending upon the desired hair style or problem of the wearer.

A still further object of the invention is to provide means whereby additional segments of hair may be secured as may be desired.

Another object of the invention is to provide a hairpiece of the type described which may be used as a "ponytail" or the like, or as a "bun".

A still further object of the invention is to provide means whereby the additional hairpiece may be sandwiched between layers of natural hair so that the frictional relationship of the added hairpiece on the natural hair and the fixed roots of the lapping natural hair anchors the same in the adjusted place position and the hair, with its sandwiched hairpiece in place, may be shampooed, wet, as in swimming without dislodgement of the hairpiece and the same may be dressed when dressing the hair as an entity with the natural hair which is an advantage where the hair is shampooed and dressed in a public place, as for example, a beauty salon since an observer is unable to detect the fact that additional hair has been added to the wearer's own head of hair. Further the hairpiece is comfortable on the head even though it is retained on the head during sleep.

Another object of the invention is to provide means whereby hair of contrasting shades on the hairpiece may be used wherefor the effect of "streaking" in the hair is secured, if desired, without the need to bleach or color the natural hair.

Additional strips of hair may be disposed on additional filament or filaments attached to the circular filament wherefor additional hair may be disposed across the head for additional streaking.

Other objects of my invention and the invention itself will become more apparent from a perusal of the accompanying description and drawings, in which drawings.

Figure 1:
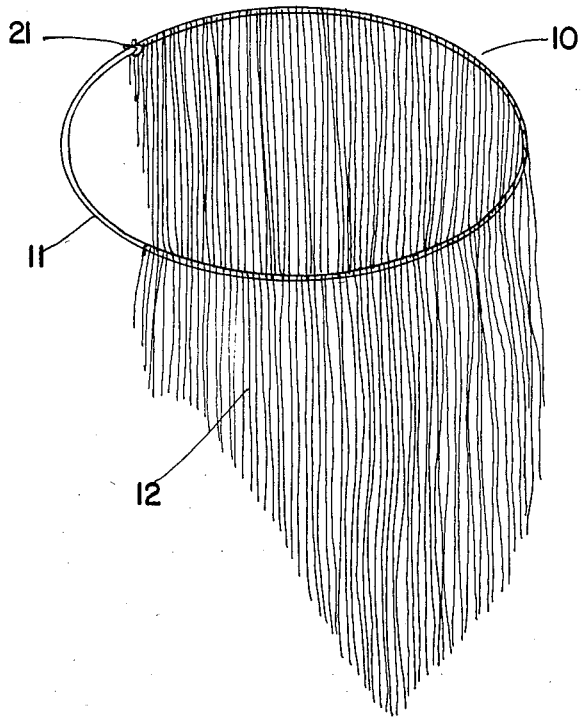
FIG. 1 is a view of the hairpiece of my invention before placement upon the head of the wearer.
Figure 3:
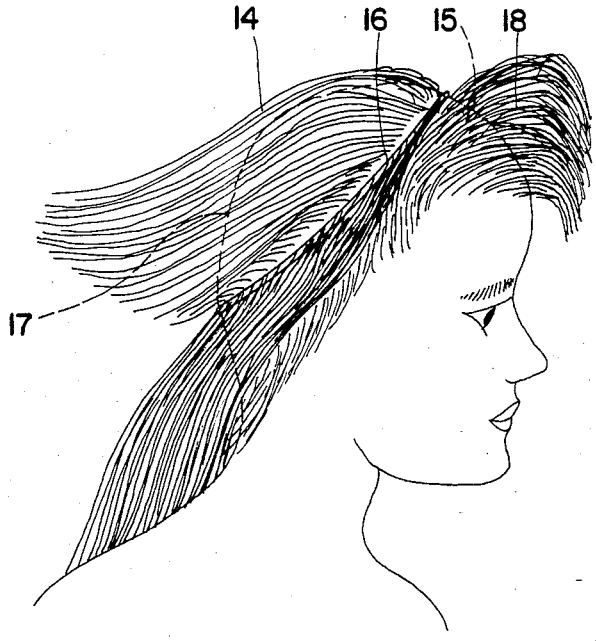
FIG. 3 is a side view similar to that of FIG. 2 showing an initial placement of the hairpiece of FIG. 1 on the head beneath a top layer of hair and about relatively lower layers of hair around the sides and back of the head.
Figure 2:
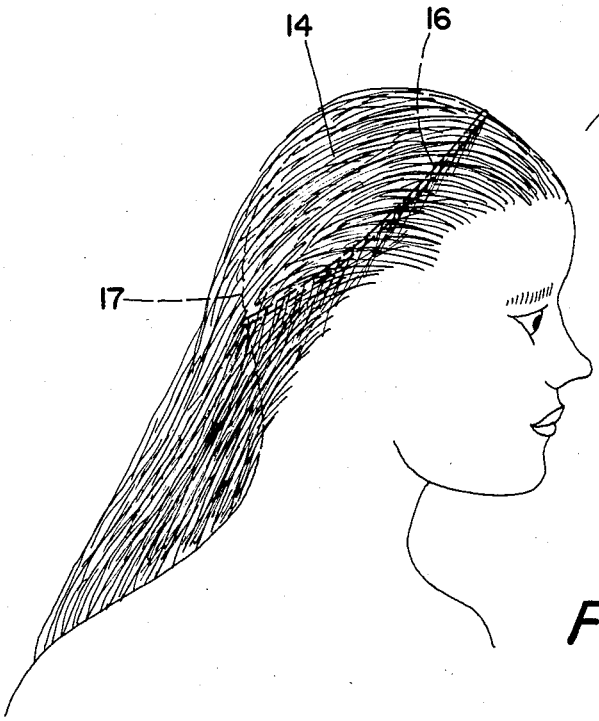
FIG. 2 is a side view showing the sandwiched layers of natural hair and the hairpiece and the ring carrying the same as worn, in dotted lines.
Figure 7:
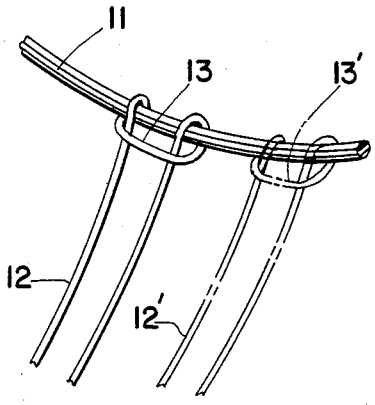
FIG. 7 is a fragmentary perspective view of a portion of the encircling filament or ring and shows a method of attaching the hair to the ring.

Referring now in detail to the drawings, and particularly to FIG. 1, in all of which drawings like parts are designated by like reference characters, there is illustrated a hairpiece 10 adapted to be sandwiched between layers of natural hair on a wearer's head as shown in FIGS. 2 and 3. In accordance with one specific embodiment as shown in FIG. 1 the piece includes an endless filament thread-like member, hair or strand forming a circlet or loop 11 of a size and dimension to encircle a rounded portion of the head, as for example, a portion of the frontal upper portion of the head, a portion of the sides and the back of the head. The circlet or loop 11 which may be either natural or artificial hairs, as nylon or other artificial material, has a plurality of hairs, either natural or artificial, adjustably attached thereto, as shown in FIG. 7 at 13 and 13' by "knotting" or the like.

The hairpiece of my invention is preferably placed on the head of the wearer by placing a portion of the circlet on the frontal portion 15 on the head 14 beneath or between portions of the natural hair or, as shown in FIG. 3, the central forward hair 18 of the wearer is brushed forward to allow portions of the circlet to encircle frontal portions of the head, underlie hair on the sides 16 and back 17 of the wearer's head wherefor the circlet 11 is anchored in place on the head by the roots of the wearer's own hair and sandwiched between overlying and underlying layers of the wearer's own hair as shown in FIG. 2. Due to the relatively thin preferably nylon filament employed as the circlet, if the wearer has a part in his or her hair, the filament's crossing thereof will be visibly virtually inconspicuous.

It will be noted that the hair on the hairpiece may be massed in and preferred manner since the same are adjustably secured to the circlet and as dictated by the problems or desires of the wearer. For example, where the natural hair is thin or the wearer has a bald spot, a suitable amount of hair on the hairpiece would be massed thereover so that the spot would have coverage. Further the wearer may desire a lesser or greater amount of volume of hair on the hairpiece and this would be provided as desired on the circlet. The hair thereon can be further, in dressing the head, adjustably moved to whatever location dictated by the artistry of the operator or wearer.

The hair dress of this invention can be, due to its secure anchorage as shown and described, dressed, brushed and washed in the same manner and without removal of the same but together with dressing, brushing, washing, etc. of the wearer's own hair. It can be worn when swimming or slept in as well.

Figure 4:
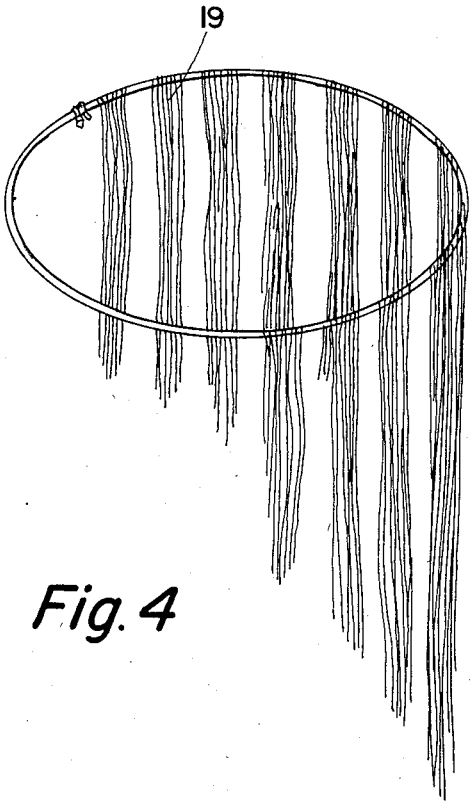
FIG. 4 is a view similar to that of FIG. 1 but discloses hairs attached to the encircling ring and separated into spaced sections of hair.

In the form of my invention shown in FIG. 4 the hair is "knotted" or otherwise adjustably secured to the circlet in spaced segments and may be, as shown, "streaked" or colored to provide a "streaking" effect of the headdress without the necessity of bleaching, coloring, etc. the natural hair. Additional segments may further be used for traversing the head and said segments are secured to a filament as on the main hairpiece, and said segments to the circlet.

Figure 5:
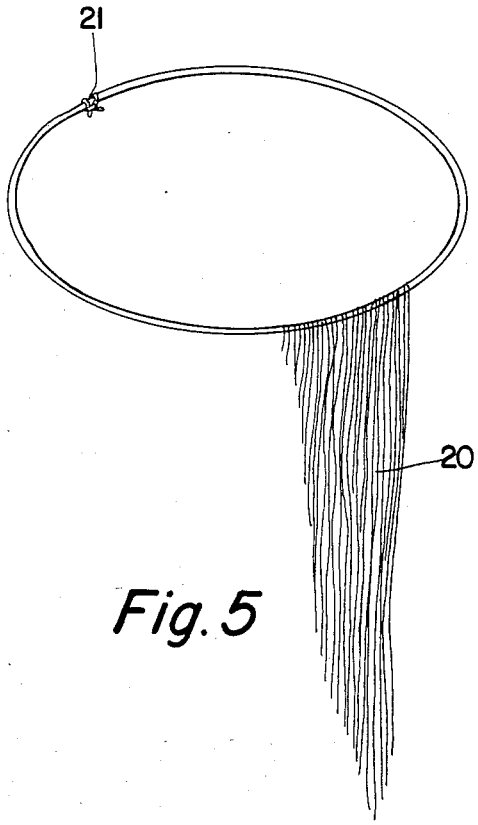
FIG. 5 is a view similar to that of FIG. 1 and shows hairs attached massed in one location on a head encircling ring.
Figure 6:
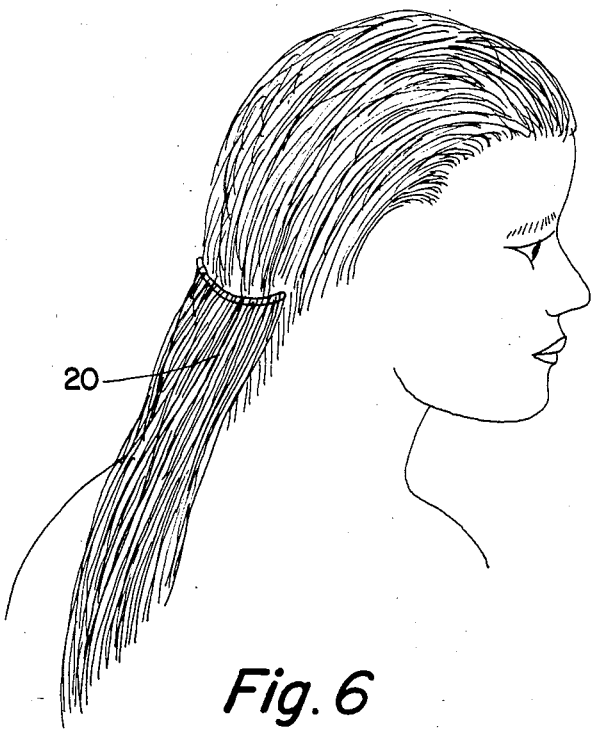
FIG. 6 is a view of the hairpiece of FIG. 1 showing the same pulled back into a "ponytail"

In FIG. 5 I have disclosed a circlet having a clump of hair 20 adjustably attached to a circlet of the type shown in FIGS. 1 and 4 which may be used as a "ponytail" by securing as shown in FIGS. 7 and 21 the circlet under and over a clump of the wearer's own hair. Then employed for bangs or spit-filling, a mass of hairs of appropriate length are brushed forwardly from the circlet, as for bangs, or brushed in any desired direction to cover a desired location on the head.

In this disclosure, I have referred to the circlet as an endless strand or filament. It is to be understood that in referring to said "strand" or "filament" the intent is to define a thread-like or hair-like member and while preferably it comprises a single thread, it may be, depending on its dimension, though slender and virtually invisible upon application and wearing, composed of a number of threads.

While I have described the invention in connection with certain improved embodiments, I am aware that numerous and extensive departures may be made therein, without however departing from the spirit of my invention or the scope of the appended claims.

What I claim is:

1. A hairpiece comprising an endless thread-like thin circlet of a size and dimension to encircle a rounded portion of a wearer's head, said circlet having a number of hairs individually secured thereto whereby said hairpiece is adapted to lay on the scalp of the wearer immediately between adjacent roots of the natural hair on the wearer's head.

2. A hairpiece of the type claimed in claim 1 wherein the hairs secured to the circlet are individually adjustably secured thereon wherefor the said hairs may be massed on the head of the wearer as desired.

3. A hairpiece as claimed in claim 1 wherein the hairpiece is retained when laid on the head by said adjacent roots.

4. A hairpiece as claimed in claim 1 wherein the circlet is manually detachable.

5. A method of adding volume to the natural hair on the head of a person by disposing a thread-like circlet having individual hairs secured thereto upon the scalp of the wearer between overlying and underlying root of the natural hair in a desired location on the head, the circlet being of a size and dimension to encircle a rounded portion of the head.

* * * * *

UNITED STATES PATENT AND TRADEMARK OFFICE

CERTIFICATE OF CORRECTION

PATENT NO. : 4,600,029

DATED : July 15, 1986

INVENTOR(S) : MARIA UEBERSCHAAR

It is certified that error appears in the above-identified patent and that said Letters Patent is hereby corrected as shown below:

Col. 3, line 10

[and] should be any

Col. 4, line 38

[root] should be roots

Signed and Sealed this

Fourteenth Day of October, 1986

[SEAL]

*Attest:*

DONALD J. QUIGG

*Attesting Officer*

*Commissioner of Patents and Trademarks*